US006286405B1

(12) United States Patent
Hamm

(10) Patent No.: US 6,286,405 B1
(45) Date of Patent: Sep. 11, 2001

(54) WORKBENCH

(76) Inventor: Richard Ernest Dunbar Hamm, 2B Milner Towers, Port Erin, Isle of Man IM9 6AG (GB)

( * ) Notice: Subject to any disclaimer, the term of this patent is extended or adjusted under 35 U.S.C. 154(b) by 0 days.

(21) Appl. No.: 09/433,203

(22) Filed: Nov. 4, 1999

(30) Foreign Application Priority Data

Nov. 18, 1998 (GB) ..... 9825500
Nov. 4, 1999 (GB) ..... 9824111

(51) Int. Cl.[7] ..... B27B 3/00; B25H 1/00
(52) U.S. Cl. ..... 83/781; 144/286.1; 269/295; 269/901
(58) Field of Search ..... 83/781; 144/286.1, 144/286.5; 269/289 R, 290, 295, 296, 297, 299, 901

(56) References Cited

U.S. PATENT DOCUMENTS 4,154,435 * 5/1979 Alessio ..... 269/901
4,155,386 * 5/1979 Alessio ..... 269/901
4,909,491 * 3/1990 Cheng ..... 269/901
6,058,990 * 5/2000 Kent ..... 269/901

* cited by examiner

*Primary Examiner*—W Donald Bray
(74) *Attorney, Agent, or Firm*—Barlow, Josephs & Holmes

(57) ABSTRACT

A workbench having four vice sections 4, 6, 8, 10 which are independently adjustable to provide a gap 32 therebetween in which to clamp a workpiece 30, and a gap 24 therebetween through which a saw can be placed in order to cut through the workpiece . An optional mitre guide 49 can be provided in order to form a guide for the saw, the position of the guide 49 being adjustable to facilitate cuts at different angles through the workpiece 30.

8 Claims, 4 Drawing Sheets

WORKBENCH

BACKGROUND OF THE INVENTION

A conventional workbench comprises a pair of elongate vice beams which form a working surface and which can be shifted relative to one another in the manner of a vice by means of a pair of independently operable vice operating screws. This known workbench is capable of clamping workpieces of different shapes and sizes between the two vice beams, such that the workpiece is firmly gripped whilst it is worked upon.

In order for a workpiece to be cut or sawn the workpiece is clamped between the vice beams and the end of the workpiece to be cut protrudes beyond the working surface, a cut is then made through the protruding end. As the cut is made the sawn off end of the workpiece drops to the floor. This has the disadvantage that as the sawn off piece is removed the weight of that piece rips through the final part of its attachment to the remaining workpiece, which can cause splintering or a rough edge to the required piece of the workpiece, This leads to additional time for the user to repair the damage, or waste of the actual workpiece if the damage cannot be repaired. In order to overcome this problem either a second person is required to hold steady the protruding end or an additional clamp for holding the protruding end at a point remote from the workbench. This has the disadvantage that it requires either additional personnel or additional equipment in order to make the cut. Also even when such is used a large number of rough or splintered workpieces still arise because the workpiece is not directly supported beneath the cutting area, thereby the workpiece can flex causing the saw to stick as it is drawn backwards and forwards through the workpiece. Furthermore the forced non uniform movements of the saw together with the metal teeth can give rise to a jagged, uneven edge to the cut surface. It is also found that splintering to the workpiece can still occur, especially if an angled or mitred cut is required.

SUMMARY AND GENERAL DESCRIPTION OF THIS INVENTION

It is an object of the present invention to overcome or alleviate the above described disadvantages.

In accordance with one aspect of the present invention there is provided a workbench comprising a stand and a work surface supported on the stand, the work surface having means to clamp a workpiece on the workbench, wherein the work surface comprises a cutter guide.

Preferably the work surface is adapted to clamp a workpiece at either side of its cutter guide. This has the advantage that a workpiece is fully supported and the sawn-off piece does not drop, reducing splintering of the workpiece.

Preferably the cutter guide is a gap within the surface of the work surface. More preferably the gap is adjustable. This has the advantage that a cutter, for example saw can pass through the gap in the surface of the work surface providing easier access to the workpiece. Preferably a recess is provided between the work surface and stand in the vicinity of the gap.

In a preferred embodiment a support tray is provided in the recess, beneath the gap, preferably the position of the tray is adjustable. This has the advantage that a piece of rough wood can be selectively placed in the tray and the workpiece supported thereon in the vicinity of its area to be cut, thereby the cutter can bear down through the workpiece, pressing the workpiece onto the rough wood further reducing flexing of the workpiece.

Preferably the workbench comprises a mitre guide for guiding a cutter through a workpiece. Preferably the mitre guide is an angled gap within the surface of the work surface. In a preferred embodiment the mitre guide is an attachment to the work surface, more preferably it is adjustable to provide complex angles to the cut.

In a preferred embodiment the cutter guide is a mitre guide.

BRIEF DESCRIPTION OF THE DRAWINGS

By way of example only, specific embodiments of the invention will now be described with reference to the accompanying drawings, in which.

DETAILED DESCRIPTION

Figure 1:
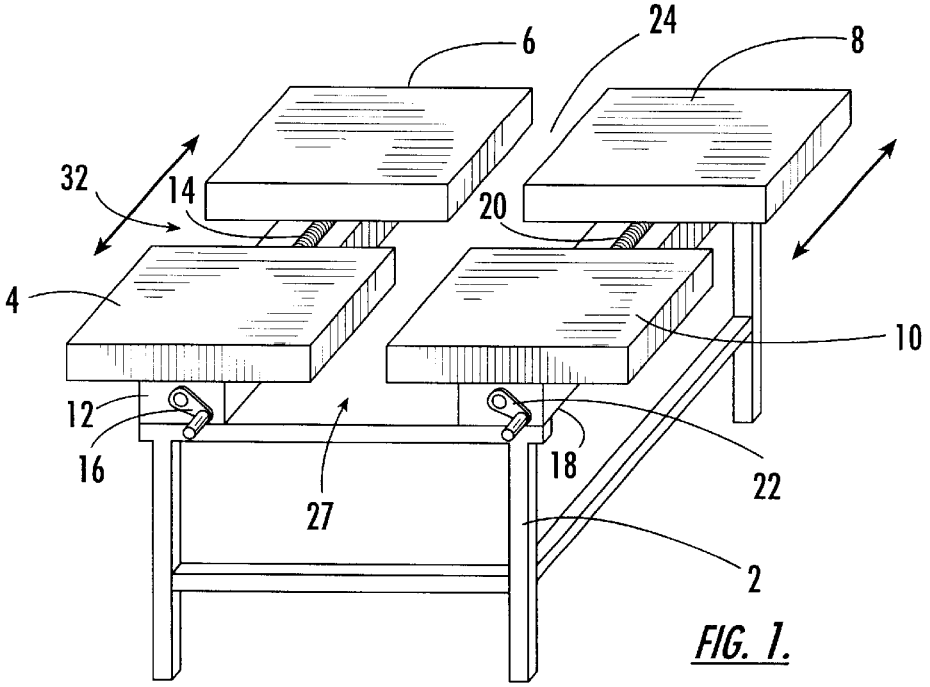
FIG. 1 is a perspective view of a workbench according to a first embodiment of the present invention.
Figure 2:
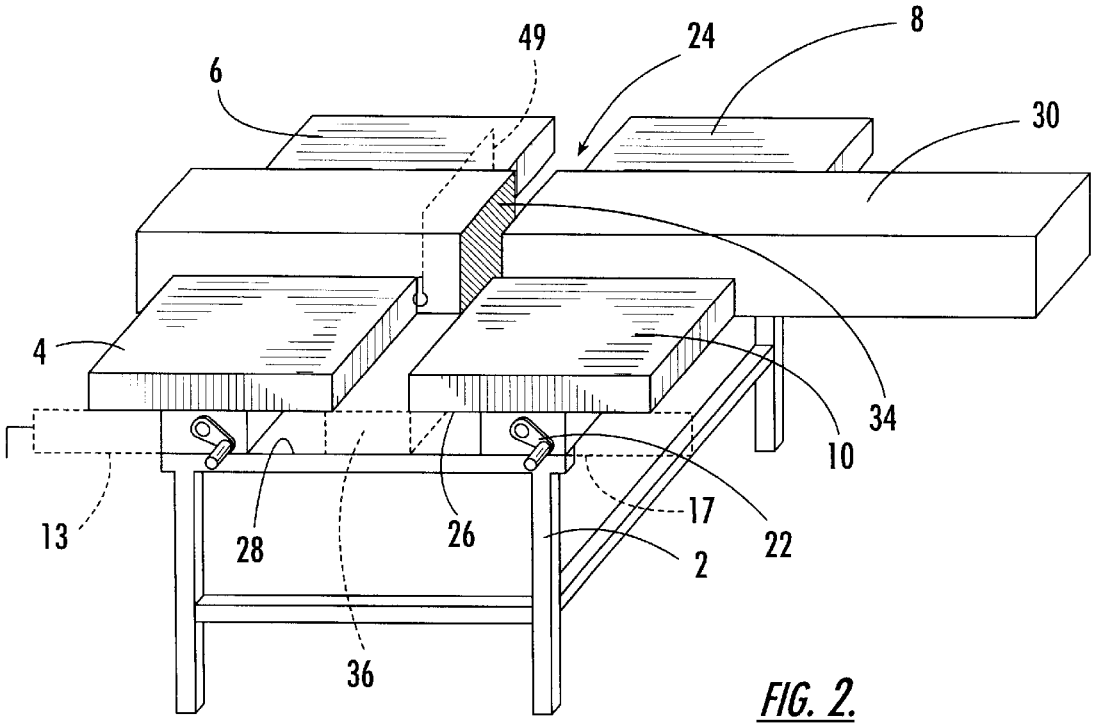
FIG. 2 is a perspective view of the workbench of FIG. 1 illustrating the clamping of a workpiece through which a cut has ben made.

Referring to FIGS. 1 and 2, the workbench comprises a stand or frame 2 and a work surface in four separable vice sections 4, 6, 8 and 10. Sections 4 and 6 are slidably mounted to a support rail 12 and can be shifted towards and away from each other by a vice operating screw 14 operable by handle 16. Likewise sections 8 and 10 are mounted to support rail 18 and are shifted by screw 20 operable by handle 22. Between sections 4 and 10 and between sections 6 and 8 is a gap 24, the use of which will be described further hereinunder. The lower surface of the work surface 26 stands proud of the top 28 of the frame 2 due to its support on rails 12, 18.

As best illustrated in FIG. 2 vice sections 4, 6 and 8, 10 are moved away from each other in order to form a gap 32. A workpiece 30, such as a length of timber is then placed into the gap 32 and is supported by the rails 12, 18, The handle 12 is then turned to move vice sections 4 and 6 towards each other until the workpiece is clamped thereby. Likewise sections 8 and 10 are moved together to completely clamp the workpiece in place. A saw, or cutter (not illustrated) can then be drawn through the workbench 30 via gap 24. Gap 24 allowing the saw to pass through the surface of the workbench, whilst the workpiece is fully retained either side of the cut 34 by the vice sections 4, 6 and 8, 10. This prevents the cut away piece falling to the floor and also renders the workpiece less flexible during the cutting process.

If additional support is required for the workpiece, a piece of rough wood 36 or the like can be placed lengthwise across the top of the frame 28. This allows the cut through the workpiece to be made on to a support surface, which further reduces flexing of the workpiece.

Figure 3:
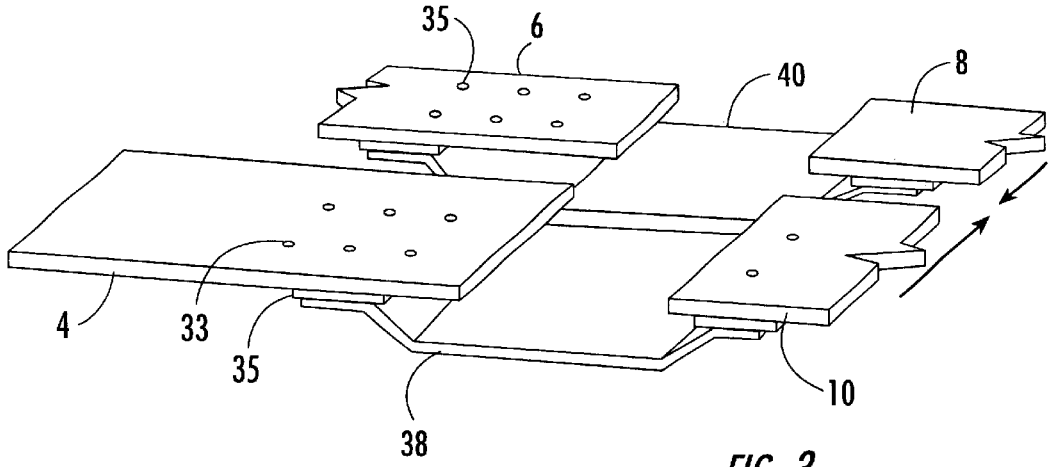
FIG. 3 is a detail of a second embodiment of the workbench illustrating the provision of a tray to hold an additional support for the workpiece.
Figure 4:
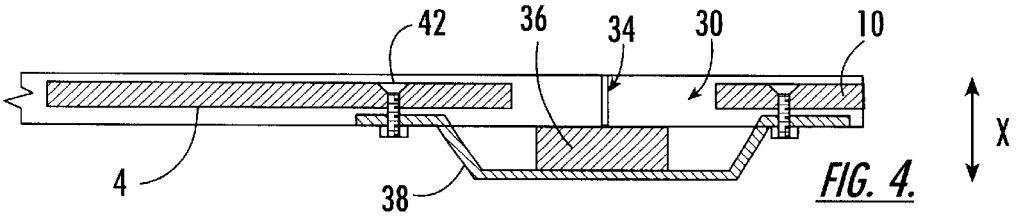
FIG. 4 is a side view of the workbench of FIG. 3 illustrating the clamping of a workpiece upon an additional support.

In the embodiment of FIGS. 3 and 4, the workbench is modified to include support trays 38, 40 for a piece of rough wood 36. Each support tray 38, 40 extends beneath the level of the work surface in the vicinity of the gap 24. Tray 38 is attached by screws 42 to the vice sections 4 and 10 and likewise tray 40 is attached by screws 42 to vice sections 6 and 8. Screws 42 are adjustable to allow the position of the tray 38 or 40 beneath the gap 24 to be adjusted in the direction X, thereby facilitating the use of different thickness or support/rough wood 36.

In a further embodiment illustrated by the dot dash lines in FIG. 2, additional rails 13, 17 are provided to facilitate the opening and closing of gap 24, whereby vice sections 4 and 10 are slidably mounted to one pair of rails 13 and 17 and vice sections 6 and 8 to the other rails not illustrated, as before handles and screws are provided to facilitate the independent operation of the vice sections. This allows the gap 24 to be adjusted in width in order to allow a variety or plurality of cuts in a workpiece therethrough. The provision of a larger gap, more readily allowing the making of an angled (mitred) cut through the workpiece. The mounting of the trays 38 and 40 also being adjustable to facilitate the placement of the trays beneath the adjustable gap 24, by providing a series of attachment points 33 for the screws 42 or by providing a rail mounting 35 along which the tray 38 can slide, Similar provisions are provided for the other tray 40.

Figure 5:
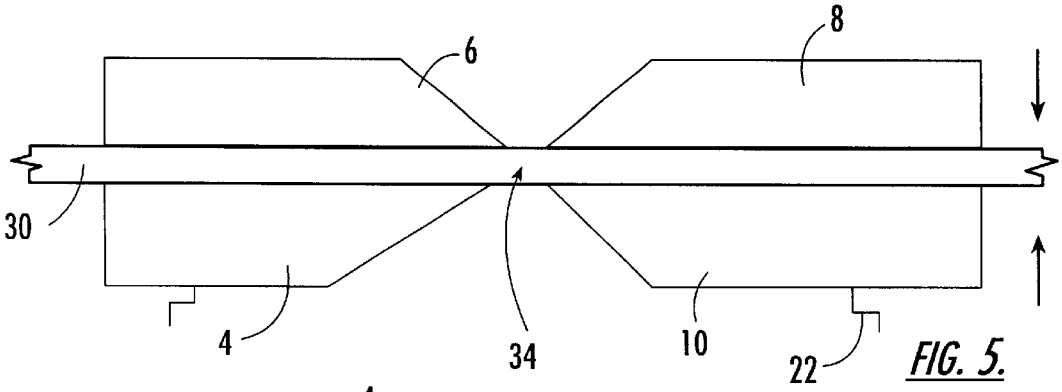
FIG. 5 is a plan detail of a further embodiment illustrating a modification t:o the work surfaces to facilitate an angle cut.

In a further embodiment of workbench, the vice sections are modified in that they are cut away at their edges adjacent gap 24, as best illustrated in FIG. 5, in order to allow angled access to a workpiece held by the workbench. This facilitates holding the saw at an angle across the work surface.

Figure 6:
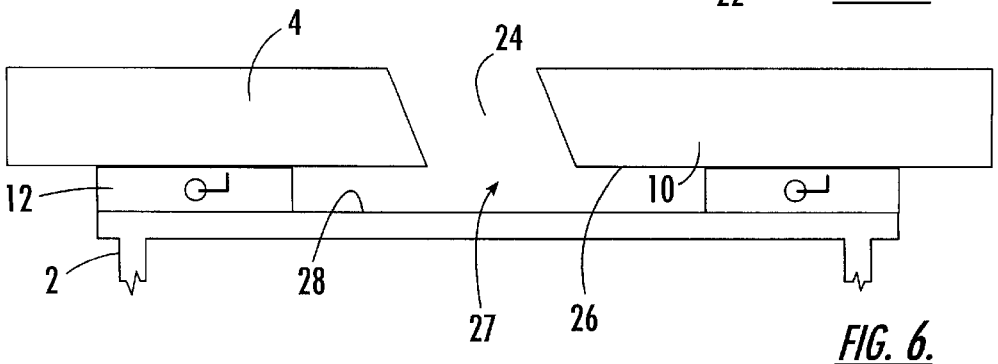
FIG. 6 is a side view detail similar to FIG. 5 but illustrating a further modification to the surface.

In a further embodiment of workbench, the vice sections are modified in that they are cut away at an angle at their edges facing gap 24, as best illustrated in FIG. 6, in order to allow a saw to go through the width of a workpiece at an angle.

Figure 7:
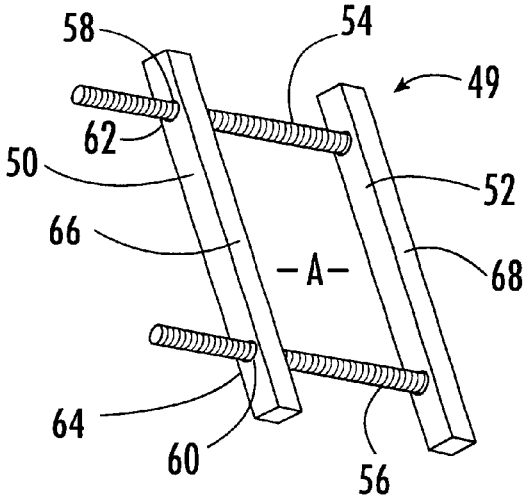
FIG. 7 is a perspective view of a cutter guide constructed in accordance with a further embodiment of the present invention.
Figure 8:
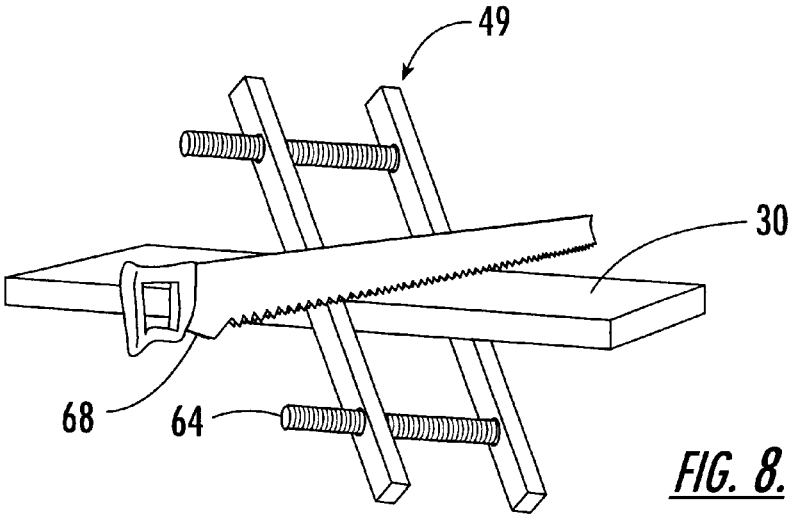
FIG. 8 illustrates the use of the guide of FIG. 7.
Figure 9:
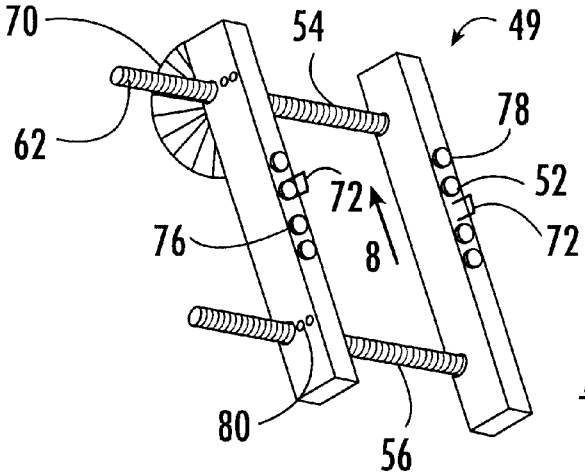
FIG. 9 is a perspective view of a further embodiment of cutter guide.

In a further embodiment of workbench as best illustrated in FIGS. 7 to 9, a mitre guide 49 is provided comprising two adjustable arms 50, 62 interconnected by two spaced screw threads 54, 56 which are received in bores 58, 60 in arm 50 and each of which threads carry a respective nut 62, 64. Tightening and loosening of the nuts enable the gap A between the arms 50,52 to be altered as desired. In use, as best illustrated in FIG. 8 a workpiece to be cut is placed through the gap A in the guide 49 and the nuts 62 and 64 are tightened until the arms 50 and 52 are clamped against the workpiece 30. The faces 66, 68 of the arms 50, 52 can then be used as a guide for a saw 68. The mitre guide is placed at a desired angle to the edges of the workpiece in order to facilitate the required angle of cut.

In order to achieve the required angle a protractor 70 or the like as best illustrated in FIG. 9 is incorporated in a further embodiment on the mitre guide to facilitate placing the arms 50, 52 at the required angle to the surfaces of the workpiece. Furthermore stops 72, 74 protrude out of surfaces 60, 68 and are independently adjustable along the direction B by placement in a desired socket 76 and 78 respectively within the arms 50, 52. This provides a stop for the saw enabling the depth of cut to be restricted as desired and also for the cut to be formed at a second angle if the stops 72 and 74 are at different heights.

Since screws 64 and 56 are independently adjustable the arms 50 and 52 are able to clamp uneven surfaces and additional adjustment of the guide 49 is provided in a further embodiment, illustrated best in the detail of FIG. 9 whereby the edge 50 of the mitre guide 49 can be provided at an angle relative to arm 52 by providing adjustment means 80 in the form of a plurality of bores 60 through the arm 50, whereby screw thread 56 can be placed through a desired bore 60 of the adjustment means 80 to place the guide 49 at the required angle.

In use the mitre guide 49 is placed through gap 24 of the workbench, a workpiece is then placed through its gap A and the guide 49 tightened to the required position for the cut. In a further embodiment, as illustrated by the dot dash lines in FIG. 2, the mitre guide is formed as an integral part of the workbench with the lower end of the guide pivotally mounted at 82 to the edge 84 of the vice section 4, whereby the winding together of vice sections 4 and 6 also clamp the guide to the surfaces of the workpiece, whilst the pivotal mounting facilitates the placement of the guide at the desired angle. In this instance the lower screw rod 56 is omitted.

Although the arms 50, 52 have been shown as straight they could in fact be shaped differently, for example they could be arc shaped to accommodate a rounded workpiece or to form an arc shaped guide for the saw. The mitre guide is manufactured from a material which will not damage the saw or cutter and the front edges 66, 68 could carry rollers to aid the motion of the saw or cutter.

Although the workbench has been described as having four vice sections, a different number of vice sections could be provided as long as a gap can be presented within the work surface to enable a saw to pass therethrough and through the work piece to be cut.

Figure 10:
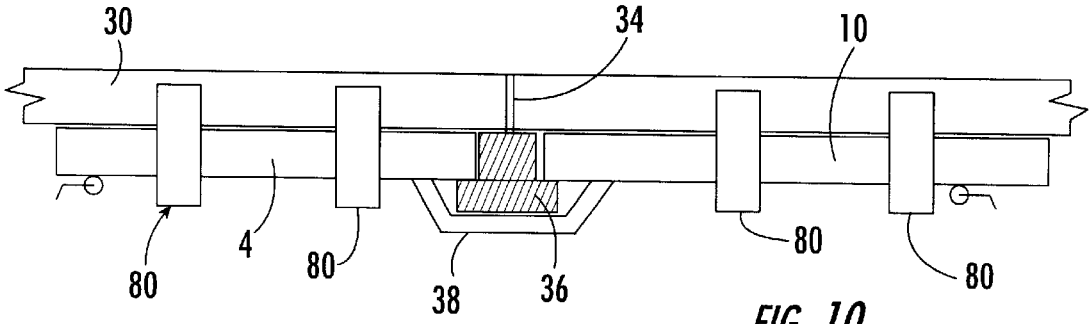
FIG. 10 is a schematic side view of a further embodiment of workbench.

Lugs 80 could be provided in the clamping surface of the work surface, as best illustrated in FIG. 10 which can hold a particularly wide workpiece over the top of the work surface, this extends the potential clamping width and a rough piece of wood 36 can be placed in gap 24 to provide additional support for the cut.

What is claimed is:

1. A workbench comprising:

a support frame;

two clamping members supported by said support frame comprising a first clamping member having a clamping edge and a planar top work surface with a first linear gap therein at an angle to said clamping edge; and a second clamping member adjacent to said first clamping member having a clamping edge and a planar top work surface in the same plane as the planar top work surface of said first clamping member, with a second linear gap therein in alignment with said first linear gap, said two clamping members being horizontally slideable relative to one another;

guide rails on said support frame between said support frame and said clamping members perpendicular to said clamping edges of said clamping members, said guide rails directing said slideable movement of said clamping members in a linear fashion; and an actuator for slicleably moving said clamping members along said guide rails for clamping an object between said clamping edges of said clamping members.

2. The workbench in claim 1 wherein said first and second linear gaps are adjustable.

3. The workbench in claim 1 wherein said first and second linear gaps are perpendicular to said clamping edges.

4. The workbench in claim 1 wherein said first and second linear gaps are at a 45 degree angle to said clamping edges.

5. The workbench in claim 1 wherein said first and second linear gaps further comprise a miter guide.

6. The workbench in claim 5 wherein said miter guide further comprises an adjustable attachment selectively mountable to said top work surfaces.

7. The workbench in claim 1 further comprising a first support tray under said linear gap in said first clamping member and a second support tray under said linear gap in said second clamping member.

8. The workbench in claim 7 wherein said support trays are adjustable.

* * * * *